F8958 OR 4,543,434

United States Patent [19]

Chang

[11] Patent Number: 4,543,434

[45] Date of Patent: Sep. 24, 1985

[54] PROCESS FOR PRODUCING LIQUID HYDROCARBON FUELS

[75] Inventor: Clarence D. Chang, Princeton, N.J.

[73] Assignee: Mobil Oil Corporation, New York, N.Y.

[21] Appl. No.: 229,245

[22] Filed: Jan. 28, 1981

[51] Int. Cl.[4] ..... C07C 15/02; C07C 19/00

[52] U.S. Cl. ..... 585/310; 208/8 R; 585/733

[58] Field of Search ..... 585/733, 310; 208/8

[56] References Cited

U.S. PATENT DOCUMENTS

| | | | |
|---|---|---|---|
| 2,041,840 | 5/1936 | Lazier et al. | 585/733 X |
| 2,309,718 | 2/1943 | Thacker | 585/733 X |
| 3,894,107 | 7/1975 | Butter et al. | 585/733 X |
| 4,265,735 | 5/1981 | Audeh et al. | 585/733 X |

OTHER PUBLICATIONS

Fischer et al., "Brennstoff-Chemie", pp. 245-249, (1938).

*Primary Examiner*—Robert V. Hines

*Attorney, Agent, or Firm*—Alexander J. McKillop; Michael G. Gilman; Howard M. Flournoy

[57] ABSTRACT

A process for the synthesis of liquid hydrocarbon fuels and hydrogen based on the use of sulfur as an oxidant.

6 Claims, No Drawings

PROCESS FOR PRODUCING LIQUID HYDROCARBON FUELS

BACKGROUND OF THE INVENTION

1. Field of the Invention

The invention disclosed and embodied herein relates to the synthesis of liquid hydrocarbon fuels and hydrogen from coal or natural gas or related materials. The invention further relates to a thermochemical cycle based on the use of sulfur as an oxidant, the recovery of sulfur and hydrogen from by-product hydrogen sulfide and to a process wherein said synthesis is carried out in the presence of a ZSM-5 type catalyst.

2. Description of the Prior Art

It is known that aliphatic organic compounds containing oxygen, sulfur, nitrogen and/or halogen constituents may be converted to aromatic hydrocarbons in commercially desirable yields in the presence of zeolites; see U.S. Pat. No. 3,894,103. It is also known that synthesis gas, i.e., mixed carbon monoxide and hydrogen, can be catalytically converted into liquid hydrocarbon fuels such as gasoline boiling range products. However, the products of such reactions are predominantly paraffinic and the product is unsuited for use in modern internal combustion engines; see U.S. Pat. No. 3,894,102. U.S. Pat. No. 3,894,102 discloses a process wherein hetero-organic compounds, RX, where R is an aliphatic moiety and X is a heteroatom such as sulfur, nitrogen, halogen or oxygen may be converted to aromatic hydrocarbons by contacting such compounds with an alumino-silicate zeolite.

Coal shale oil and/or tar sands are some of the raw materials used to provide materials for hydrocarbon conversion but to applicant's knowledge heretofore such technology unlike the present invention has used oxygen rather than sulfur as the oxidant.

SUMMARY OF THE INVENTION

A novel process for the synthesis of liquid fuels from methane or natural gas, coal and/or related materials is disclosed herein. Further, an economical means of producing hydrogen is also provided. The aforementioned process offers an attractive alternative to prior art methods of coal gasification and $CH_4$ steam reforming.

DESCRIPTION OF PREFERRED EMBODIMENTS

Liquid hydrocarbon fuels and $H_2$ are co-produced according to the novel following series of integrated steps:

| | |
|---|---|
| From coal | |
| $C + 2S \rightarrow CS_2$ | [1] |
| $CS_2 + H_2O \rightarrow COS + H_2S$ | [2] |
| $COS \rightarrow \frac{1}{2}CO_2 + \frac{1}{2}CS_2$ | [3] |
| $\frac{1}{2}CS_2 + 3/2H_2 \rightarrow \frac{1}{2}[CH_2] + H_2S$ | [4] |
| $H_2S + n/2\ M \rightarrow M_{n/2}S + H_2$ | [5] |
| $M_{n/2}S \rightarrow n/2\ M + S$ | [6] |
| $C + H_2O \rightarrow \frac{1}{2}[CH_2] + \frac{1}{2}CO_2 + \frac{1}{2}H_2$ | A |
| From CH4 | |
| $CH_4 + 4S \rightarrow CS_2 + 2H_2S$ | [7] |
| $CS_2 + 3H_2 \rightarrow [CH_2] + 2H_2S$ | [4] |
| $4H_2S \rightarrow 4H_2 + 4S$ | [5] + [6] |
| $CH_4 \rightarrow [CH_2] + H_2$ | B |

Reactions 1, 3 and 7 are, as is readily known to one of ordinary skill in the art, well known, M in the above recited steps 5 and 6 is a metal such as, Fe, Co, Ni or a Group V-A metal such as bismuth, or a Group VI-B metal such as Mo, or any combination thereof.

It is further noted that reactions 4 and 5 set forth above may be carried out as described in one step or in two steps as follows:

$$CS_2 + 3H_2 \xrightarrow{\text{Co or Ni}} CH_3SH + H_2S \quad [8]$$

$$CH_3SH \xrightarrow{\text{HZSM-5}} [CH_2] + H_2S \quad [9]$$

The inventive aspect of the present invention is a combination of the ordered sequential reactions utilized to produce the bottom line reactions A and B and the specific manner, i.e. such as molar ratio, etc., in which the reactants are utilized therein.

Usually in accordance herewith the above reactions [4] and [9] take place in the presence of a zeolite type catalyst. The zeolites particularly useful herein include ZSM-5, ZSM-11, ZSM-12, ZSM-35 and ZSM-38. These zeolites may be base exchanged, contain hydrogen or ammonium ions or a metal cation. Examples of suitable metals include Co, Co/Mo, Zn, Zn/Pd, Ni, Ni/W, Ni/Mo, etc. Generally speaking, most Group II and Group III metals of the Periodic Table may be used. A preferred typical catalyst is CoHZM-5.

U.S. Pat. No. 3,702,886 which describes and claims ZSM-5; U.S. Pat. No. 3,709,979 which describes and claims ZSM-11; West German Offenlegungsschrift No. 2,213,109 which describes ZSM-12; U.S. Pat. No. 4,016,245 which describes ZSM-35; and U.S. Pat. No. 4,046,859 which describes ZSM-38 are incorporated herein in their entirety.

The practice of the novel process of the present invention is particularly described below in preferred embodiments.

TABLE

| | EXAMPLE 1 | EXAMPLE 2 |
|---|---|---|
| Reaction Conditions | | |
| $CS_2$, LHSV | 1 | 1 |
| $H_2$, GHSV | 400 | 400 |
| T, °F. | 900 | 900 |
| P, psig | 250 | 250 |
| Catalyst | HZSM-5 | 50% HZSM-5/$Al_2O_3$ 50% Co/$SiO_2$ (Harshaw Co-401) |
| $CS_2$ Conversion, % | 25.6 | 40.3 |
| HC, wt. % | | |
| $C_1$ | 52.4 | 44.7 |
| $C_2$ | 9.2 | 6.1 |
| $C_2$ | 1.9 | — |
| $C_3$ | 3.0 | 3.7 |
| $C_3$ | 0.3 | 0.1 |
| i $C_4$ | 0.2 | 0.2 |
| n $C_4$ | 0.2 | 0.3 |
| $\bar{C}_4$ | — | — |
| $C_5$+nonaro | — | tr |
| $A_6$ | 1.4 | 2.6 |
| $A_7$ | 5.9 | 7.7 |
| $A_8$ | 8.2 | 9.5 |
| $A_9$ | 4.6 | 18.1 |
| $A_{10}$ | 0.3 | 3.2 |
| $A_{11}$+ | 12.4 | 3.8 |

The reaction parameters for reaction [4] may vary from 400° F. to 1200° F. and 0 psig to 2000 psig, for reaction [5], from ambient temperature to about 500° F. and 0 psig to 2000 psig, and for reaction [6] from 500° F. to about 2000° F.

The preferred reaction conditions for reactions 4, 5 and 6 are as follows:

for reaction [4]:
700°–1000° F.
25–50 psig for reaction [5]:
25°–400° F.
50–1500 psig for reaction [6]:
600°–1500° F.

The methane and the coal were obtained from commercial sources.

The embodiments and details outlined above are noted hereinabove solely for the purpose of illustrating the invention and, as is readily apparent to one of ordinary skill in the art variations and departure can be made therefrom within the scope of the invention.

I claim:

1. A catalytic process for converting coal to a liquid hydrocarbon fuel and hydrogen mixture comprising the sequential steps of:

(a) contacting said coal with sulfur thereby forming a product comprising carbon disulfide;

(b) contacting the carbon disulfide with water thereby forming a product comprising a carbonyl sulfide fraction and a hydrogen sulfide fraction;

(c) disproportionating the carbonyl sulfide fraction into a product comprising carbon dioxide and carbon disulfide, and removing the carbon disulfide as a separate product;

(d) hydrogenating the carbon disulfide in the presence of a ZSM-5 type zeolite catalyst at a temperature of between about 400° and about 1200° F. and at a pressure of between about 0 and about 200 psig and separating the reaction product into a hydrogen sulfide fraction and as a desired product a hydrocarbon fraction;

(e) contacting said hydrogen sulfide fraction of (d) with one or more metals selected from the group consisting of Group VI-B and Group VIII metals thereby forming a metal sulfide and hydrogen at a temperature of between about ambient and about 500° F. and at a pressure of between about 0 and about 2000 psig; and (f) recovering said metal sulfide of (e) and thermally decomposing it at a temperature of about 500 to about 2000° F. into a metal and elemental sulfur.

2. A catalytic process for converting natural gas comprising primarily methane to a liquid hydrocarbon fuel mixture and hydrogen comprising the sequential steps of:

(a) contacting said natural gas with sulfur thereby forming a reaction mixture of carbon disulfide and hydrogen sulfide;

(b) contacting the carbon disulfide with hydrogen in the presence of a ZSM-5 type catalyst, thereby forming a product mixture of hydrocarbons and hydrogen sulfide;

(c) separating the hydrocarbons as a desired product, and contacting said hydrogen sulfide product of (b) with one or more metals selected from the groups consisting of Group VI-B and Group VIII metals thereby forming a metal sulfide and hydrogen at a temperature of between about ambient and about 500° F. and a pressure of between 0 and about 2000 psig; and (d) recovering said metal sulfide of (c) and thermally decomposing it at a temperature of about 500° to about 2000° F. into a metal and elemental sulfur.

3. The process of claim 1 or 2 wherein the ZSM-5 type catalyst is selected from the group consisting of ZSM-5, ZSM-11, ZSM-12, ZSM-35 and ZSM-38.

4. The process of claim 3 wherein said zeolites are base exchanged, and containing hydrogen or ammonium ions or a suitable metal cation.

5. The process of claim 4 wherein the catalyst has a metal cationic component.

6. The process of claim 5 wherein the metal component is selected from the group consisting of Co, Co/Mo, Zn, Zn/Pd, Ni, Ni/W and Ni/Mo.

* * * * *

UNITED STATES PATENT AND TRADEMARK OFFICE

CERTIFICATE OF CORRECTION

PATENT NO. : 4,543,434

DATED : September 24, 1985

INVENTOR(S) : Clarence D. Chang

It is certified that error appears in the above-identified patent and that said Letters Patent is hereby corrected as shown below:

Column 2, line 26, "Group III" should read --Group VIII--.

Column 3, line 5, "25-50" should read --25-500--.

Column 4, line 34, after "exchanged" delete "and".

Signed and Sealed this

*Eighteenth* Day of *February 1986*

[SEAL]

*Attest:*

DONALD J. QUIGG

*Attesting Officer*

*Commissioner of Patents and Trademarks*